United States Patent [19]

Snow

[11] 4,455,329

[45] Jun. 19, 1984

[54] METHOD FOR COATING THE INTERIOR SURFACE OF METAL PIPES

[75] Inventor: William E. Snow, Birmingham, Ala.

[73] Assignee: American Cast Iron Pipe Company, Birmingham, Ala.

[21] Appl. No.: 436,044

[22] Filed: Oct. 22, 1982

[51] Int. Cl.[3] ..... B05D 7/22

[52] U.S. Cl. ..... 427/234; 427/239

[58] Field of Search ..... 427/234, 239

[56] References Cited

U.S. PATENT DOCUMENTS 3,253,075 5/1966 McLaughlin et al. .

4,390,568 6/1983 Schwenk et al. ..... 427/234

OTHER PUBLICATIONS

"Mainstay Composite Concrete Pipe", Mainstay Corporation, Oct. 1969.

*Primary Examiner*—James R. Hoffman

*Attorney, Agent, or Firm*—Kerkam, Stowell, Kondracki & Clarke

[57] ABSTRACT

A method for coating metal pipe with a thixotropic coating having a wet film thickness between 30 to 120 mils. The coating is a coal tar epoxy made up of a two component resin and pigment blend with the pigment comprising two sizes of glass beads. The coating material is applied via a slinger rotated within the bore of a pipe while it is moved slowly end to end past the slinger. The coating material is discharged from the slinger in a 360° radial pattern in a plane substantially perpendicular to the axis of the pipe and direction of movement so as to cause a build up of a ring of the material of uniform thickness and thereby form incrementally, but continuously, due to continuous movement of the pipe, a coating of uniform thickness. The pipe is thereafter rotated while the coating is wet to develop a centrifugal force in the range of 50 g to 100 g. The pipe may also be vibrated while being rotated to enhance depletion of air bubbles and spread of coating into cracks and interstices in the internal surface of the pipe and form a smooth lining.

7 Claims, 6 Drawing Figures

METHOD FOR COATING THE INTERIOR SURFACE OF METAL PIPES

BACKGROUND OF THE INVENTION

1. Field of the Invention

This invention relates generally to a method and an apparatus for coating the interior surface of a pipe and more particularly to a method and apparatus for providing a uniform corrosion resistant protective coal tar epoxy coating on the interior surface of a pipe subject to a high corrosive environment.

2. Description of the Prior Art

To protect metal pipe from corrosion due to water, steam, chemicals, acids, and so forth, it is required to coat the inner surface of the pipe with a continuous coating which is not only free of holidays, pin holes and the like, but one which is corrosion resistant and which will protect the pipe against attack from the corrosives contained in the materials being handled. Sewer pipes are particularly vulnerable to attack by corrosive agents because of their exposure to various chemicals, acids and gases such as, for example, $H_2S$.

Some of the various patented practices developed over the years for coating the interior surfaces of a pipe include the following:

U.S. Pat. No. 2,353,951—Wood et al. This patent relates to the deposit of a suspension of colloidal graphite into the pipe and thereafter inserting a roller member in intimate contact with the interior surface and rotating the roller member so as to cause the graphite particles to penetrate and fill the interstices in the surface. U.S. Pat. No. 2,845,366—Schroeder. This patent relates to metallizing very long pipe lengths with aluminum while the pipe is rotated, but maintained longitudinally stationary, or vice versa, and fusing the aluminum coating into the roughened wall. U.S. Pat. No. 3,359,943—Briggs et al. This patent relates to the application of a zinc silicate coating on the inner surface of a long length pipe and employs a flexible conduit and nozzle with centering means which is drawn through the pipe as the coating is sprayed on the interior surface. U.S. Pat. No. 3,974,306—Inamuro et al. This patent discloses a method wherein the coating composition is applied to the interior surface of a preheated pipe by feeding a dry powder at one end and sucking air at same time from the other end.

While the above patents illustrate several known methods of coating interior surfaces of pipe, they are not intended to suggest that these are the only methods. Methods will necessarily vary depending on the materials employed, the nature of the pipe and the use to which it will be subjected. Other examples of known methods of coating the interior surface of a pipe can be found in the following U.S. patents: U.S. Pat. No. 2,399,606—Schuh et al U.S. Pat. No. 2,731,690—Coupland U.S. Pat. No. 2,563,843—Johnston U.S. Pat. No. 2,729,190—Pawlyk U.S. Pat. No. 3,007,810—Hobrock U.S. Pat. No. 3,347,699—Hitzman U.S. Pat. No. 3,563,791—Janci U.S. Pat. No. 4,254,165—Phelps Known methods of coating the interior cylindrical surface of pipe generally suffer from one or more disadvantages. For example, the lamination bond may be weak or production costs may be undesirably high. To increase bonding, resort is often made to special materials which are costly and/or require special pipe treating procedures such as preheating.

Spray coating is a popular method of applying coatings, but generally requires relative rotation between the spray head and pipe, with the movement causing a spiral effect in the coating. Unless the movement and spray pattern are accurately controlled, gaps may occur. To compensate for gaps, coating is often applied in multiple layers undesirably increasing production time and also increasing the possibility of uneven lapping. Spray coating is generally limited to low viscosity materials because of the tendency of viscous materials to clog small orifices.

Other known methods employed for coating long length pipe, i.e. a pipe whose length is several times its diameter, in the neighborhood of eighteen or twenty feet, suggest applying the coating from opposite ends. This causes an overlap at the center of the pipe, and because the first applied coating may set before the other coating is applied, such coatings are prone to delamination.

SUMMARY OF THE INVENTION

The method and apparatus of the present invention have been especially designed for utilization in coating the interior of pipes which may be up to 20 feet in length and which have an inside diameter of 4 to 54 inches to provide an improved corrosion resistant epoxy lining incorporating a thixotropic agent.

A particular consideration in coating such pipes is to provide a dry film thickness with certain critical limits. These limits are generally established by experimentation depending on the use to which a pipe is used and the materials used. For example, it has been found that when utilizing a coal tar epoxy, the desired dry film thickness should preferably be within the range of 40 to 80 mills and in some applications as much as 120 mills. If the coating is either substantially less in thickness or substantially greater in thickness than its desired range, it becomes ineffective for the intended purpose.

In order to obtain the proper thickness of the highly viscous coating on the interior of the pipe and to provide a uniform coating, it is necessary to provide a slinger nozzle which provides a uniform discharge of coating material on the surface. Regardless of whether the nozzle is moved through the pipe or the pipe surface moved past the nozzle, it is important to provide a substantially uniform, accurately controlled rate of movement of the moving member. This can be achieved by providing a uniform rate of movement of the pipe member by mechanical means. A substantially uniform coating of desired thickness is assured by controlling the speed of movement of the member and the rate or amount of coating material applied to the interior of the pipe.

Notwithstanding the progress that has been made over the years in developing pipe coating materials and methods of coating, a need exists for more reliable coatings and more economical methods of manufacture.

It is therefore an object of the present invention to provide a new and improved method and apparatus for coating the interior surface of a pipe.

Another object of the present invention is to provide a new and improved method and apparatus for coating the interior surface of sewer pipe with a coating which is free from holidays and skips and which readily resists the corrosive effect of sewer gases and acids.

Still another object of the present invention is to provide a highly efficient and highly economical method and apparatus for applying thixotropic agents as coatings or linings for the interior cylindrical surface of metal pipes.

The method and apparatus of the present invention are particularly directed to the use of a polyamide cured, two component coal tar modified epoxy as a lining for the interior surface of sewer pipe in the order of 18 or 20 foot lengths. The coating agent is blended in a ratio of one part resin to approximately eight parts activator and applied via a slinger head supported for rotation to a hollow shaft motor. The motor is in turn supported to a cantilevered stationary coating delivery tube with the end of the delivery tube passing through the hollow shaft to the slinger head. The other end of the delivery tube is connected at the mixing station to receive the coating material.

A characteristic of the thixotropic coating agent is that its flowability decreases with decreasing temperatures. If operation of the method is to be conducted at ambient temperatures below 50° F., it may be advantageous to include a heater in the mixer and mount the delivery tube in a heating jacket.

In accordance with the method of the invention, the pipe having a surface to be coated is loaded onto a dolly adapted to be moved along parallel ground rails positioned parallel to the axis of the delivery tube. The pipe is supported on the dolly at a height such that the delivery tube passes through the longitudinal center axis of the pipe. A relative reciprocal movement is provided between the pipe and dolly. Movement of the dolly is effected mechanically by a motor driven auger or screw disposed to mesh with a half-nut carried beneath the dolly carriage. Operation of the auger causes the pipe to be shifted slowly and uniformally toward the slinger and delivery tube which enter and pass through one end of the pipe as it continues its movement to its maximum limit of travel. At the maximum limit of travel, the position of the slinger coincides with the far or other end of the pipe. The slinger motor and coating material pump are energized as the pipe approaches the slinger. The manner in which the coating is fed into the slinger and high speed of rotation of the slinger causes the coating to be thrown out evenly in a 360° pattern from the edge of the slinger and in a plane substantially perpendicular to the longitudinal axis of the pipe and its direction of movement. The coating is applied in the form of an annular ring of substantially constant thickness on the interior surface of the pipe. As the pipe is moved, the annular ring of coating material moves progressively toward the far end of the pipe, thus coating the pipe from one end to the other with a uniform thickness in a one pass operation. Upon reaching the maximum limit of travel, motion of the dolly is reversed, but because no coating is applied during this reverse motion, the dolly can be returned at a high rate of speed. The coated pipe is unloaded laterally from the dolly to a spinning station as a second pipe is rolled onto the dolly. The coating process is repeated for the second pipe, while the previously coated pipe is transported to a high speed roller.

It should be noted that the thixotropic agent when applied to the surface of the pipe does not spread because of its high shear viscosity. Rotation of the coated pipe while the coating agent is wet causes the coating agent to flow and be distributed into the interstices and voids in the pipe surface. To this end, the coated pipe is rotated at a high rpm for about 30 secs. to develop a force between 50 and 100 g that removes air bubbles in the coating and creates a smooth surface. Thereafter the pipe is removed from the spinner and allowed to air cure at a temperature above 50° F. Curing times may be reduced by subjecting the pipe and or its coating to heat. At 50° F., a curing period of approximately 72 hours should allow the coating material to be completely set and a hard lining to be formed. This curing time can, of course, be affected during storage or shipment of a pipe to its location for intended use.

BRIEF DESCRIPTION OF THE DRAWINGS

Other objects and many attendant advantages of the invention will become more apparent when considered in connection with the following specification and the accompanying drawings, wherein.

DESCRIPTION OF THE PREFERRED EMBODIMENTS

Figure 1:
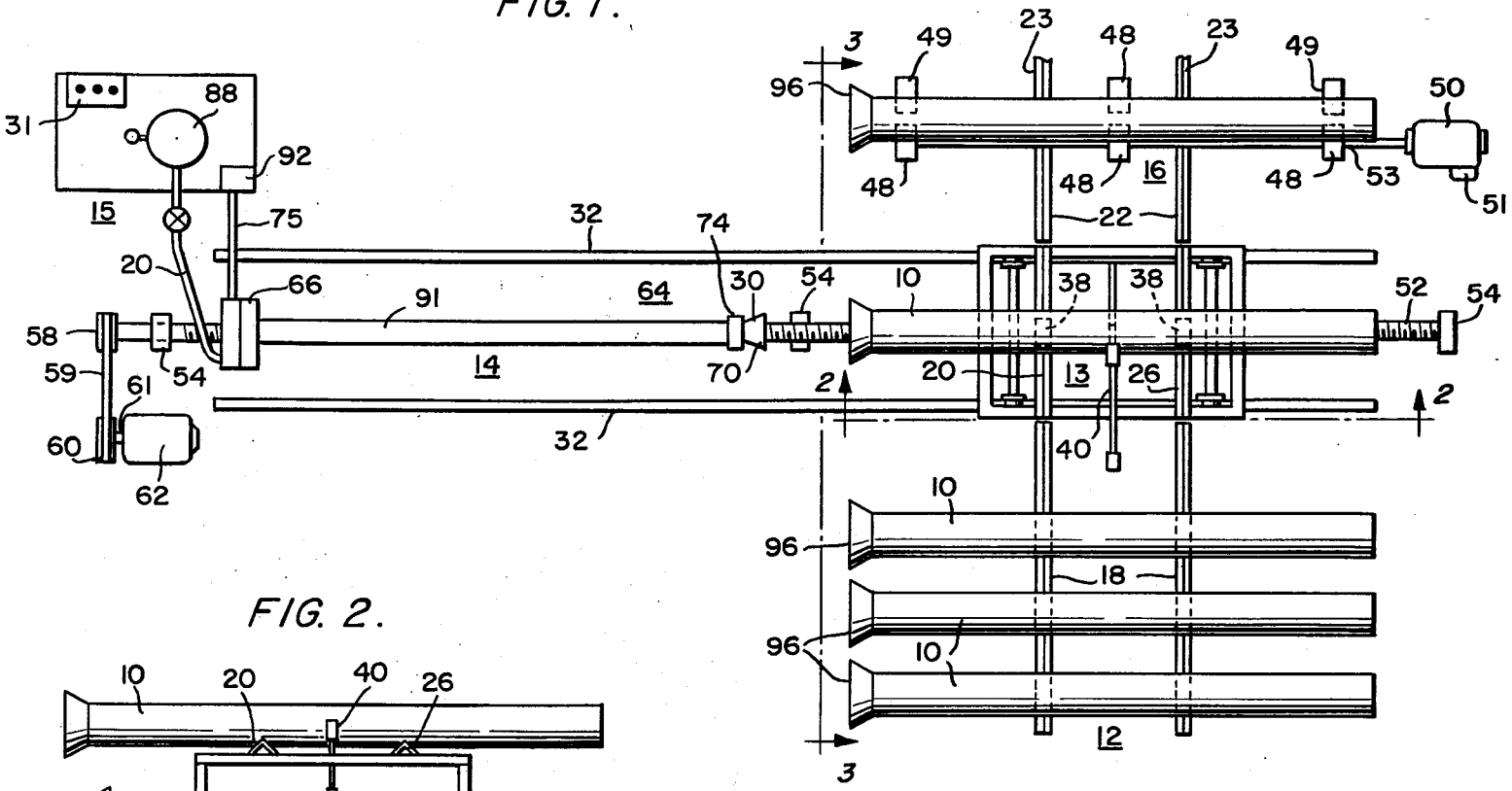
FIG. 1 is a diagramatic top view illustrating the overall arrangement of the apparatus.

The present invention is directed to a method and apparatus for coating the interior surface of sewer pipe, generally having a length of approximately 20 feet and an internal diameter of between 20 inches, with a coal tar epoxy lining having a preferred wet film thickness of approximately 40–80 mills and a dry film thickness of approximately 30–70 mills. The specific thickness of the lining may vary slightly from point to point due to initial roughness of the interior surface of the pipe. While a wet film thickness of 40–80 mills is preferable, a lining having a range in the order of 30 to 120 mills will provide effective protection against corrosion, scale or oxidation and provide a relatively smooth interior surface for conveying fluids with reduced surface friction. Likewise, the method and apparatus can be used for coating the interior surface of other than sewer pipes and pipes of other diameters and lengths.

Various materials have been utilized in the past for coating pipe, such as, cement, colloidal graphite, plastics, synthetic resins, coal tar pitch and the like. In accordance with the present invention, the interior pipe surface is advantageously coated with a thixotropic agent such as coal tar epoxy having a high shear viscosity which is built-up in an annular ring of uniform thickness at point of application, but which ring is applied continuously to provide a continuous uniform coating which is caused to flow to fill any cracks, voids or interstices by subjecting the coated pipe to high speed rotation and/or vibration while the coating is wet.

It is known that the centrifugal force created at the interior surface of the pipe can be expressed by the following formula in terms of the force of gravity:

$$K_g = \frac{N^2 D}{7.05 \times 10^4}$$

where $K_g$ represent a centrifugal force equal to K times the force of gravity, N is the speed of rotation of the pipe in revolutions per minute and D is the inside diameter of the pipe in inches. As will be hereinafter described, in accordance with the present invention, the coated pipe is spun at an rpm sufficient to develop a centrifugal force in the order of 50 to 100 g. For a 20 inch diameter pipe, with a thickness of 0.36 inch, 150 g centrifugal force developed on the coating requires a speed of approximately 600 rpm. A 50 g force requires a speed of about 420 rpm for the same size pipe. This produces a final lining which is smooth and of uniform thickness and free of air bubbles. Spreading of the coating may be enhanced by subjecting the pipe to vibration while it is rotating.

A preferred lining material is a coal tar epoxy sold commercially under the brand name RUFF STUFF 2100 Coal Tar Epoxy by Indurall Coatings, Inc. of Birmingham, Ala. This coal tar epoxy is a catalized two component agent that combines the corrosion resistant characteristics of coal tar pitch with those of epoxy resin. Specific details as to the composition of RUFF STUF 2100 coal tar epoxy and its method of manufacture may be obtained from U.S. Pat. No. 4,171,228, the subject matter of which is hereby incorporated by reference.

As noted in U.S. Pat. No. 4,171,228, the coal tar epoxy coating material comprises two parts or components. One component is a resin and the other component is a pigment made up of a catalizer, solvent, glass beads (two sizes) and thixotropic agent. In accordance with the present invention, the coating material is prepared by blending eight parts by volume of the pigmented component, including liquid coal tar as the thixotropic agent, and one part by volume of clear component prepared by dissolving a polyamide resin in xylene. The coating material may be applied in the desired thickness at ambient temperature by means of an airless slinger nozzle, but should the temperature be below 50°, heaters may be employed to increase flowability of the material.

Before the coating is applied on the interior surface of the pipe, the inside thereof should be thoroughly cleaned. The surface should in its natural state be somewhat roughened to facilitate adherence of the coating to the walls. For pipes which have a smooth surface, the surface may be roughened. The surface may be cleaned by subjecting it to a well known form of blast cleaning operation employing sand, steel grain or other abrasive material. This blast cleaning operation serves to remove any protective coating which may have been applied to the pipe at the mill to prevent corrosion during storage and transport and also to remove any scale or foreign matter which may have found its way into the pipe or formed on the walls. Sand blasting of the interior surface also serves to roughen the surface and facilitate adherence and bonding of the coating to the interior cylindrical surface of the pipe.

Figure 2:
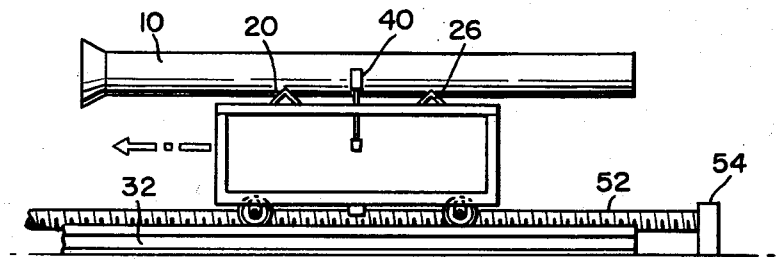
FIG. 2 is a fragmentary front elevational of the apparatus shown in FIG. 1 and taken along the lines 2—2.
Figure 3:
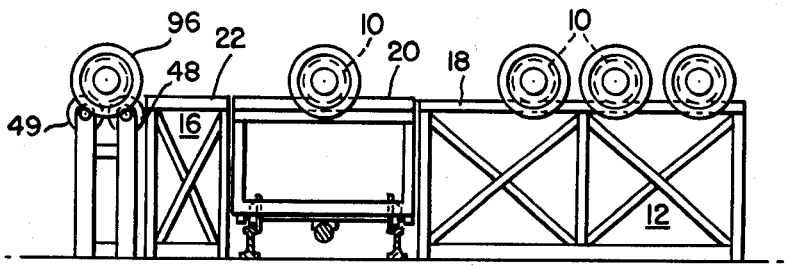
FIG. 3 is a side elevational view of the apparatus shown in FIG. 1 taken along lines 3—3.

Referring now to the drawings, FIGS. 1, 2 and 3 show in diagrammatical form a manufacturing layout or arrangement which may be used for lining pipe 10 in accordance with the present invention. As shown, the manufacturing layout includes a pipe receiving or storage station 12, a loading station 13, a pipe coating station 14, a coating agent mixing and control station 15 and a pipe spinning station 16 arranged in production line fashion and interconnected by means of pairs of rails 18, 20 and 22 and ground support rails 32, all of which enable the pipe to be transported conveniently between stations. Additionally, a pair of rails 23 may be provided leading away from the spinning station so as to provide means for transferring the lined pipe to a storage and/or shipping location (not shown).

Each of the pair of rails 18, 20, 22 and 23 are disposed at a height above the ground level to facilitate handling of the pipe and inspection by workers. In addition, rails 18, 22 and 23 may be arranged to slope downwardly at a slight angle so that the pipe may be transferred between operating stations simply by rolling the pipe along the rails under the influence of gravity.

As best shown in FIG. 3, rails 18 and 22 are supported in elevation by conventional structural support or frame members 24 and 26, respectively, so that a dolly 28 supporting rails 20 can freely pass there between. The spacing between the ends of rail 20 and the adjacent ends of rails 18 and 22 is such that a pipe can be conveniently rolled from one pair of rails to the other along the axis of the rails and the clearance is such that it will allow the dolly 28 and rails 20 to pass freely between rails 18 and 22. Suitable pipe engaging or stop means (not shown) may be provided at convenient locations along the rails to selectively restrict rolling movement of the pipes. The stop means may be manually operated or be of the salenoid type controlled both locally and at control station 15 which includes an operator control panel 31 containing the necessary switches for controlling operation of various motors and controls at the various manufacturing stations.

Referring to FIGS. 1 and 2, it will be seen that dolly 28 is adapted for movement along a pair of spaced parallel ground support rails or tracks 32 which extend from a point adjacent control station 15 to a point beyond the receiving station 12 and spinning station 16, passing there between. Dolly 28 includes a plurality of frame members 34 which support its rails 20 in the plane of rails 18 and 22. Wheels 36 are rotatably supported by depending portions extending downwardly from the frame 34 of the dolly or carrier 28. These wheels travel on rails 32 that extend parallel to the axis of the coating application apparatus 30 and perpendicular to the line of movement of pipe 10 from the receiving station 12 to the spinning station 16.

The longitudinal axis of the pipes to be coated is coaxially alined with the coating applicator 30 to insure proper distribution of the coating material. To this end, means such as grooves, depressions or notches or stops 38 may be provided or associated with rails 20 to center the pipe 10 to be coated on the carrier 28. A pusher or ejection means 40 may be included on the carrier 28 to assist in initiating a roll to the coated pipe and pushing the coated pipe off the carrier onto rails 22 of the spinning station after the coating operation is complete or if a defective pipe was noted. Illustratively, ejection means 40 may include a shaft member 42 rotatably supported to the carrier frame 34 parallel to the longitudinal axis of the pipe. A first bar 44 affixed to the shaft extends upwardly and slightly beneath the centered pipe. The first bar 44 in its retracted position does not interfere with travel of the pipe across the rail. A second bar 46 affixed to shaft 42 extends downwardly and terminates in a handle portion 47 operatively accessible to an operator. By raising the handle portion 47, shaft 42 is rotated slightly counterclockwise causing the end of rod 44 to be raised from its retracted position to a position which causes the end to engage pipe 10 so as to raise it slightly and cause it to move away from the stop or centering means 40 and thereby allow it to be rolled to the spinning station.

Spinning station 16 includes two or more sets of rotating rollers 48, 49 (three sets being shown in FIG. 1) driven by a variable speed motor 50. The apparatus for spinning pipe 10 at the spinning station is conventional. Motor 50 may be automatically controlled in a known manner from control station 30 or from a local control arrangement 51 to cause the coated pipe 10 to be rapidly accelerated to a high rpm for approximately 30 seconds so as to develop a centrifugal force between 50 g and 100 g which causes the thixotropic coating to be forced into the surface cracks and interstices. Rotation of the pipe is effected while the coating is wet. If desired, the pipe may be vibrated during the spin operation to enhance spreading of the coating and removal of air bubbles that may otherwise be entrapped. To this end, rollers 48, 49 may be grooved or notched as shown at 53 to induce a mechanical shaking action or vibration to the pipe while spinning.

Movement of the dolly or carrier 28 is effected mechancially to provide a smooth continuous movement of the pipe through the coating station 14. To this end, a helically threaded auger 52 is disposed between the ground transport rails 32 and is supported for rotation in spaced barring blocks 54. Auger 52 threadingly engages a half-nut 56 mounted to the undercarriage and has mounted thereto, at one end, a pully 58. Pully 58 is connected to driving pully 60 via belt 59. Pully 60 is in turn mounted to the drive shaft 61 and reversible DC motor 62. DC motor 62 may be controlled locally at control 63 or from the operator control 31 at control station 30.

In operation, energization of motor 60 causes drive shaft 61 and auger 52 to be rotated in one direction. Auger 52 which meshes with half-nut 56 in turn causes the carrier to be transported along ground rails 32 at a desired speed. When the thixotropic coating agent is being applied to the interior of the pipe 10, the carrier 28 is driven at a relatively continuous slow speed to insure uniform application of the coating. Upon completion of the application of the coating, the motor 62 is reversed and run at a high speed to return the carrier 28 to its loading station 13. During return of the carrier 28 to the loading station 13, application of coating material is discontinued.

The speed of the motor, along with the rate of feed of the coating agent, are two variables which can be used to control the thickness of the coating. Generally, the motor will be operated to provide a pipe travel speed of between 4 to 60 ft per min. Smaller diameter pipes are transported at the faster speeds. The coating material is applied at a rate of between 2 gal to 10 gal per minutes, the rate being controlled by operation of a variable speed DC motor which drives a gear pump at the mixer.

The coating agent or material may be applied to the inner surface of pipe 10 by a coating applicator 30, such is illustrated at the left of FIG. 1. The applicator apparatus 30 is mounted at one end of a fixed support 66 so that its applicator head 68 mounted at the other end is aligned to pass through the center of pipe 10 as the pipe is conveyed by carrier 28 from right to left as viewed in FIG. 1. The applicator head 68 is a specially designed motor driven slinger 70 shown in greater detail in FIG. 4. Slinger 70 is conically shaped element mounted for rotation to the hollow shaft 72 of a conventional Tate air or vane motor 74 connected to a suitable air supply via conduit 75. Slinger 70 includes a hollow/cylindrical well section or shaft 76 mounted at one end to the hollow shaft 72 of motor 74. The other end of shaft 76 includes an expanding funnel or conical shape wall section 78 that terminates with an annular lip 80.

Extending from the support 66 in cantilever fashion is a rigid coating applicator or delivery tube 82 which passes through the hollow shaft 72 of air motor 74. Tube 82 extends into well section 76, but terminates short of the angled walls of funnel section 78 of slinger 70. The open end of tube 82 is plugged with a removable plug 84 that allows access to the tube for cleaning. Adjacent the ends of tube 82 are disposed a plurality of exit openings. Preferably, four openings are provided each space 90° apart to allow the coating agent to be dispersed simultaneously along several surface locations of the well 76 as the slinger is rotated at a high speed in the order of 150 rpm. This insures development of a 360° coating pattern extending from the lip end of the slinger as the slinger is rotated so as to cause the coating to be built up with a uniform thickness. It has been found that one opening causes a higher build up in one section of the ring, while two openings in the delivery tube result in two sectors of the ring which have a noticeable higher building of material than other portions of the ring. Three or more equally spaced openings result in a uniform build-up of coating material and four or more openings are preferable.

Figure 4:
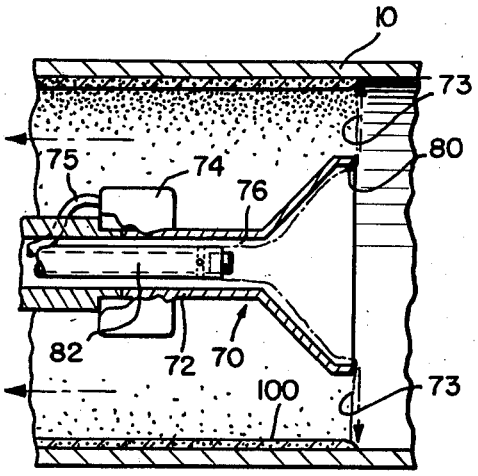
FIG. 4 is a detailed view of the slinger used for applying the coating material to the interior surface of the pipe.

Rotation of motor shaft causes the coating agent delivered into the well to migrate from the well section to the slinger walls 72 and over annular lip 80 as shown by the dash lines in FIG. 4. As the coating agent flows over the lip, it forms a 360° radial pattern 73 in a plane substantially perpendicular to the longitudinal axis of the pipe and slinger. Viewing the pattern 73 from the end, i.e. looking into the slinger, which is one would see viewing into pipe 10 from the loading station 13, as the spray is being applied, gives the appearance of a solid disc having a central circular opening corresponding to the diameter of the annular lip. Thus, the coating material coming off the slinger can be likened to a flattened donut shape.

As the pipe 10 is moved along with carrier 28 past the slinger, continued application of the agent by slinger 70 causes the interior of the pipe to have a continuous coating 100 formed thereon. The buildup of the coating material forms a ring on the interior surface which effectively moves along the surface at the speed of the carrier continuously being replenished or built up by new material from the slinger. The application of the coating 100 is continued until the far end of the pipe 10 passes the slinger 70 such that the coating 100 is applied end to end. It should be apparent that the length of the applicator apparatus extending from support 66 must be at least as long as the longest pipe 10 to be coated.

The coating composition may be conveniently applied from a mixer 88 disposed at control station 15. Mixer 88 includes a suitable container in which the ingredients are mixed. An electric motor may be mounted over the container may be used for driving an agitator in the container to mix the ingredients. The ingredients may also be mixed manually. A motor operated gear pump may be used to feed the coating composition through a supply conduit 90 to the delivery tube 82. Use of a variable speed D.C. motor enables the rate of feed to the applicator to be controlled. The rate may be varied between 2 to 16 gal per min depending on the size of the pipe, the speed of the carrier and the thickness of the layer desired. Control station 15 may also have located thereat a suitable operator's control panel 31 connected to control energization of the various motors and control elements located at the various operating stations. An air supply 92 affords connection via tube 75 to air motor 74. However, motor 74 may also be electrically energized in which case the air supply would not be needed. Suitable heating means may be included in mixer 88 to allow operation at temperatures below 50°F. Likewise, tube 75 may be enclosed in a suitable heating jacket 91 to promote flowability of the coating material at cooler temperatures.

As previously noted, the coating composition establishes a uniform high build protective coating on the interior cylindrical surface of a pipe and the thixotropic coating is preferably a coal tar epoxy composition of the type described in U.S. Pat. No. 4,171,228. Such a composition, as noted in the aforenoted patent includes a special combination of pigments selected from a first group consisting of low density pigments of smooth nodular shape having a maximum particle size of 325 microns with not less than 40% by weight retained on a 325 mesh screen and a second group consisting of pigments having a median particle diameter ranging from 0.5 to 20 microns and being shaped so that no more than 20% by weight of the particles have ratios of any two dimensions exceeding 10. The total pigment volume concentration of the coating material is not less than 40% and the total volume of both groups of pigments is not less than 75% of the total volume of pigments in the coating material with a blend of both groups containing from 20 to 95% by volume of the first group of pigments and from 5 to 80% by volume of the second group of pigments.

To prepare the high build epoxy-polyamide coating used in the present invention, an epoxy resin in a solution at 75% non-volatile in the methyl isobutyl ketone and a portion of the xylene is used to provide a clear component. Urea-formaldehyde resin is purchased as a solution at 50% non-volatile in the butanol and a portion of the xylene for the pigmented component, the urea-formaldehyde solution being combined with two-thirds of the epoxy solution and the glycol ether is added. While agitating on a high speed disperser commonly used in the manufacture of paint, all of the pigments except the microspheres are added. Also the coal tar thixotropic additive, and xylene are added as required for proper consistency. Agitation is continued for at least twenty minutes and until the batch temperature reaches at least 120° F. The microspheres and the balance of the epoxy solution are then added. After agitating for ten minutes, the remaining ingredients are added and agitation is then continued until homogeneous. The composition is then strained through a 50 mesh screen.

To prepare the clear component, the polyamide resin is dissolved in the xylene using a suitable mechanical mixer.

To prepare the coating for application eight parts by volume of the pigmented component is mixed in mixer 88 with one part by volume of the clear component and the coating is applied at normal ambient temperature through the airless applicator or slinger 70. In a single pass operation, pipe 10 may be coated end to end to a wet film thickness between 30 and 120 mils.

Figure 5:
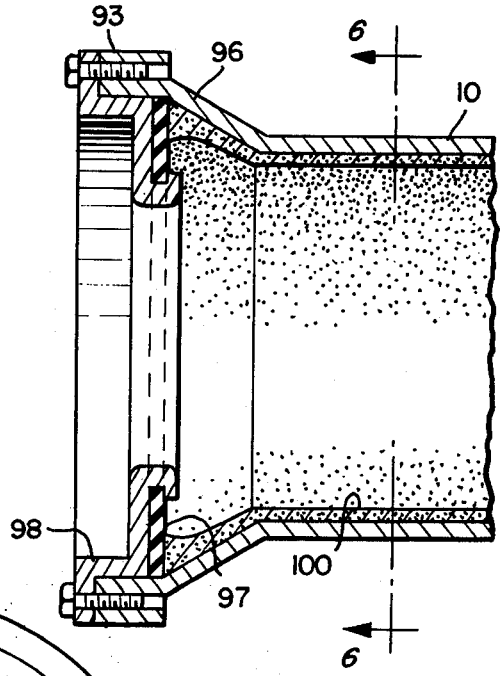
FIG. 5 is a fragmentary end view of the bell section of a pipe with the gasket in place to reduce spread of the coating during the spinning operation.
Figure 6:
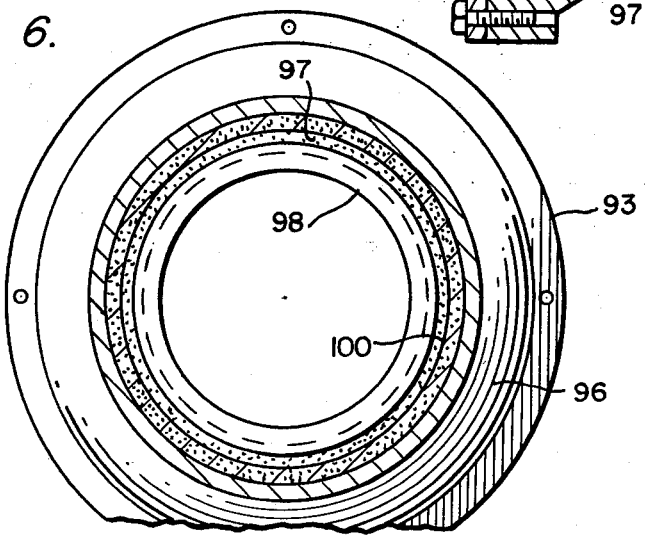
FIG. 6 is an elevational view of the pipe taken along the lines 6—6 of FIG. 5.

In operation, pipe 10 to be coated is rolled along rails 18 to the receiving station. Generally, several pretreated pipes ready for coating will be stored at the receiving station. Such pipes may be of constant inside diameter end to end, but conventionally will include a bell end section 96, as more clearly shown in FIGS. 5 and 6. Because the bell end 96 of the pipe may include sharp corners at the bends, the inside surface of the bell end is precoated by hand by brush application of a layer of thixotropic coating material. Thereafter, a gasket 97 is added having an inside diameter smaller than the desired inside diameter of the pipe after coating at the point where the gasket is mounted. In this manner, the inside surface of the gasket establish a dam as at 98 which stops spread of the wet coating during the spinning operation. An end shield 98 sized to compress the inner rim of the gasket is held in place therein and prevents the bell end and gasket from being coated. The gasket 97 and end shield 98 are retained in the pipe during spray application of the coating material. The end shield is removed prior to spinning and the gasket is removed after the spinning operation is complete.

After coating the bell end 96, pipe 10 is rolled onto the wheeled carrier 28 and set in the center position so that its central axis is aligned with the axis of the spray apparatus. The coating components are mixed at the mixing station and when ready DC motor 62 is energized to rotate auger 52 and cause the carrier 28 and the pipe 10 carried thereby to be advance toward slinger 70 such that the slinger will pass the length of the bore of the pipe. As the bell end 96 approaches the slinger, motor 74 is energized to bring the slinger up to speed and then pump motor at the mixer is also energized to cause the thixotropic coating agent to be fed to the supply tube 82. The coating agent is dispersed into the well section of the slinger via the spaced openings adjacent the end of the supply tube. The material travels over lip 82 of the slinger and is formed into a 360° radial disc pattern 73 causing a build up of the material in the form of a ring on the inner wall of the pipe 10. As pipe 10 continues its travel, the build up of material affectively occurs incrementally, but continuously, along the inside surface of the pipe and the build up of material continues progressively along the length of the pipe so that a continuous coating 100 is formed end to end. Travel speed of the carrier 28 and application of the coating is controlled so as to form a coating 100 having a wet thickness in the range of 30 to 120 mils. After the entire length of the inside surface of the pipe has been coated, carrier 28 is rapidly returned to its start position with the coating apparatus shut down. The coated pipe is thereafter rolled onto rails 22 and transferred to the spinning rollers 48, 49 of the pipe spinner. Motor 51 is energized to bring the rollers up to speed. The desired speed should be reached in approximately 5–10 seconds and maintained for another 30 seconds before stopping rotation. Upon completion of the spinning operation, the pipe is transferred to a storage or shipping operation where the lining is air cured. If ambient temperatures are below 50° F., the lined pipe may be subjected to heat to speed drying of the lining material.

As this invention may be embodied in several forms without departing from the spirit or essential characteristics thereof, the foregoing description is thereof illustrative and not restrictive of the invention. Reference should be made to the appended claims to determine the full scope of the invention and it is intended by the claims to embrace all modifications and variations which will suggest themselves to those skilled in the art and which fall within the medes and bounds of the claims.

I claim:

1. The method of coating the interior surface of a metal pipe comprising establishing a relative reciprocal motion between the pipe and a coating applicator in a direction parallel to the longitudinal axis of the pipe so as to cause the applicator to pass the length of the bore of the pipe while discharging from said applicator a thixotropic coating material in a 360° radial pattern and in a plane substantially perpendicular to the axis of the pipe to thereby build up a ring of said coating material of uniform thickness and form incrementally, but continuously, a coating of uniform thickness on the interior surface and thereafter rotating said pipe while the coating is wet to form a smooth continuous pipe lining.

2. The method of claim 1 further including the step of vibrating said pipe while said pipe is rotating to enhance depletion of air bubbles in the coating and formation of a lining having a smooth surface.

3. The method of claim 1 wherein said pipe is rotated at a speed sufficient to develop a centrifugal force on the coating in the range of 50 g to 130 g.

4. The method of claim 1 including the step of feeding the coating material to the applicator for discharge therefrom wherein said coating material is fed to said applicator through at least three circumferentially spaced orifices onto a rotating cylindrical surface and caused to migrate to a rotating sloping conical surface having an open end of diameter greater than that of said cylindrical surface and thereafter slung into said radial pattern.

5. The method of claim 1 wherein the coating material is discharged at a selected rate and said relative reciprocal motion is maintained at a selected speed such that a uniform coating is applied to the inside surface of the pipe having a wet film thickness in the range of 30 to 120 mils.

6. The method of claim 1 wherein said coating applicator is stationary and the pipe is moved past the coating applicator.

7. The method of claim 6 wherein the pipe is moved past the applicator in a first direction at a first speed and in a second, reverse, direction at a second speed, one of said speeds being slower than the other and the coating application is effected during movement of the pipe at the slower speed in a single pass of the applicator through the bore.

* * * * *